US006935965B1

(12) United States Patent
DeVarney

(10) Patent No.: US 6,935,965 B1
(45) Date of Patent: Aug. 30, 2005

(54) GOLF CLUB DEVICE AND APPARATUS FOR TEACHING GOLF SWING RHYTHM AND TEMPO

(76) Inventor: Craig Neil DeVarney, 68 South St., Essex Jct., VT (US) 05452

( * ) Notice: Subject to any disclaimer, the term of this patent is extended or adjusted under 35 U.S.C. 154(b) by 0 days.

(21) Appl. No.: 10/826,932

(22) Filed: Apr. 19, 2004

(51) Int. Cl.[7] ..... A63B 69/36
(52) U.S. Cl. ..... 473/224; 473/234
(58) Field of Search ..... 473/219, 224, 473/234, 252, 453, 220; 434/252, 247; 273/446

(56) References Cited

U.S. PATENT DOCUMENTS 4,191,378 A * 3/1980 Morin et al. ..... 473/224
4,840,371 A * 6/1989 Harris ..... 472/56
5,040,790 A * 8/1991 Anthes et al. ..... 273/446
5,082,281 A * 1/1992 Berghofer ..... 473/207
5,558,519 A * 9/1996 Sabowitz ..... 434/247
5,743,807 A * 4/1998 Bendo et al. ..... 473/234
5,868,633 A * 2/1999 Keheley ..... 473/220
6,224,386 B1 * 5/2001 Suzuki ..... 434/252
6,517,352 B2 * 2/2003 Smith ..... 434/252
6,572,492 B2 * 6/2003 Tinsman ..... 473/353
6,746,247 B2 * 6/2004 Barton ..... 434/247

* cited by examiner

*Primary Examiner*—Gregory Vidovich
*Assistant Examiner*—Nini F. Legesse

(57) ABSTRACT

The invention is a device included with a golf club that plays an audible, musical sound file during performance of a golf swing for the benefit of learning a repeatable, rhythmic motion. A sensor detects the first movement of a golf swing and automatically begins the playing of a sound file selected from a library of files stored on the device. The sound files contain musical notes and the recorded sound of a golf club striking a golf ball. The timing of the notes and recorded sounds contained in the sound file has been synchronized to the study of the timing and rhythm of proficient golfers. The sound emits from the head of the golf shaft, distal to the grip end, for the benefit of listening to where the club is located with respect to the timing of the melody played.

6 Claims, 3 Drawing Sheets

GOLF CLUB DEVICE AND APPARATUS FOR TEACHING GOLF SWING RHYTHM AND TEMPO

FIELD OF INVENTION

The present invention relates to the field of golf swing training, and more particularly, to a device included with a golf club for teaching golf swing rhythm and tempo.

BACKGROUND OF THE INVENTION

Golf swings performed by individuals proficient in the sport exhibit qualities of smoothness, rhythm, and timing. Improving the quality of said attributes is essential for all golfers that desire to obtain a higher skill level.

Golf instruction and writings commonly teach association of a verbal cadence with performing the golf swing. Students are instructed to count out loud "one, two, three" as they swing a golf club back and through. This exercise reinforces the learning of a repeatable golf swing, but the exercise lacks relationship to the known rhythm and timing of a proficient golfer.

Effective golf swings are continuous in motion. The golf swing of a proficient and elegant golfer appears to flow effortlessly in a continuous analog manner. The golf swing consists of a back swing, a change of direction, and a strike of the ball. There are no pauses or hurried movements. The performance of the swing is continuous, with but one digital aspect wherein the club, once stationary and adjacent to the ball, is placed in motion to start the golf swing.

The rhythm of an effective golf swing does not have equal proportions. The proper stroke is similar to the cracking of a whip. The amount of time used for: drawing the whip back, changing directions, and sending the whip forward, are disproportionate. Any attempt to equalize these periods of time or introduction of a pause would ruin the effort of cracking a whip, or likewise, performing a golf swing.

Proficient golfers complete the golf swing in slightly less, or more than one second. It is also a characteristic of proficient golfers that they repeat the phases of the golf swing with a precision measured in hundredths of a second.

In U.S. Pat. No. 6,517,352 (Smith) the invention disclosed attempts to teach a golf swing using metronome cadence. In U.S. Pat. No. 5,743,807 (Bendo/Varga) the invention disclosed attempts to teach a rhythmic swing by creating a plurality of click sounds. In both of these prior art inventions the student is instructed to synchronize the initial movement of the golf swing with the appropriate click. U.S. Pat. No. 5,743,807 (Bendo/Varga) further instructs the student to pause, and become still during performance of a golf swing. In U.S. Pat. No. 6,503,149 the invention disclosed provides a device included with a golf club capable of creating a whistle sound respective to the velocity the club is moving.

There are three major failings with both prior art Smith and Bendo/Varga. They both require the student to attempt a critical synchronization of the initial movement of a golf swing to a free running audible signal. This synchronization is a difficult and ineffective requirement to place on the golf student. Failure to precisely mate the origination of the golf swing to the intended proper click noise renders the practice out of phase. The object of these two inventions is to teach a repeatable rhythmic golf swing, yet the designs require the student to keenly focus elsewhere.

An additional failing of prior art inventions are they teach the golf swing to include phases of equal time value and a pause of motion. This is contrary to the continuous, rhythmic motion of golf swings performed by proficient golfers.

An additional failing of prior art inventions are they represent the golf swing in a digital manner. Audible clicks are fully off or on, presenting a stop and go cadence. This directs the students' focus to a few positions of the golf swing and retards the learning of a continuous, rhythmic motion.

Accordingly, an object of this invention is to provide a device included with a golf club that plays a plurality of selectable, audible, recorded sound files. A subsequent object of the present invention is that the device synchronize the playing of said sound files to the initial movement of the club performed in starting a golf swing.

Another subsequent object of the present invention is that the audible sounds contained in the files be continuous without pause.

Another subsequent object of the present invention is that the recorded sound files are time justified to the study of golf swings performed by skilled golfers.

Another subsequent object of the present invention is that a variety of sounds that comprise the sound files are justified to the positions of proficient golfers with a minimum resolution of a one hundredth of a second.

Another subsequent object of the invention is that said sound files include the recorded sound of a golf club striking a golf ball.

Another subsequent object of the invention is that said sound files utilize changes in pitch, volume, and timing synchronized to the study of the rhythm and timing of proficient golfers.

Another subsequent object of the invention is that the recorded sound files contain musical notes, creating a melody that is synchronized to the rhythm and timing of proficient golfers.

Another subsequent object of the present invention is that the sound provided by the device originates at the head of the golf shaft, distal to the grip end.

Another subsequent object of the present invention is that the device, and included golf club, exhibit weight and balance typical to golf clubs.

SUMMARY OF THE INVENTION

Accordingly, the present invention is directed to a device and apparatus for teaching a golfer to swing in a continuous, rhythmic, repeatable manner, synchronized to values of proficient golfers.

The device included with a golf club comprises of a trigger switch, a circuit board, a battery source, a speaker, and address selection switches.

The trigger switch comprises of a pendulum and contact, wherein the pole of the switch is the pendulum and the contact is stationary.

When the device and included golf club is held vertically, adjacent to a golf ball in a common golf address position, the trigger switch is an open circuit. When the golfer initiates a golf swing the club is accelerated away from the ball. At said instant the pendulum strikes the contact completing a circuit sensing the beginning of a golf swing.

The circuit board provides a storage array, addressing, speaker control, and playback ability for the recorded sound files. A plurality of switches provide address selection of various recorded sound files stored on the circuit board.

Accordingly, an advantage of the invention is that the device senses the initial movement of a golf swing and immediately commences play of a stored sound file.

A subsequent advantage of this invention is that the sound files contain musical notes synchronized to the study of timing and rhythm of proficient golfers. Computer study of golf swing video provides timing information, and in this embodiment of the invention, the swing analysis program CSWING a product of CSWING LLC was utilized. A sound editor is used to manage recorded sounds and create the sound files, and in this embodiment of the invention, the program GOLDWAVE a product of GOLDWAVE Incorporated was used. The timing of musical notes and recorded sounds within the sound files are synchronous to the timing analysis of the golf swing. The precision of said synchronization is one—one hundredth of a second.

Additionally, the sound file contains the recorded sound of a golf ball being struck, wherein the acoustical attributes of the strike sound have been altered and modified to add a musical tenor to the recording.

The resultant sound files are precise and melodic representations of golf swings performed by proficient golfers, each sound file being a specific representation of a specific golf swing.

DETAILED DESCRIPTION OF A PREFERRED EMBODIMENT OF THE INVENTION

Figure 1:
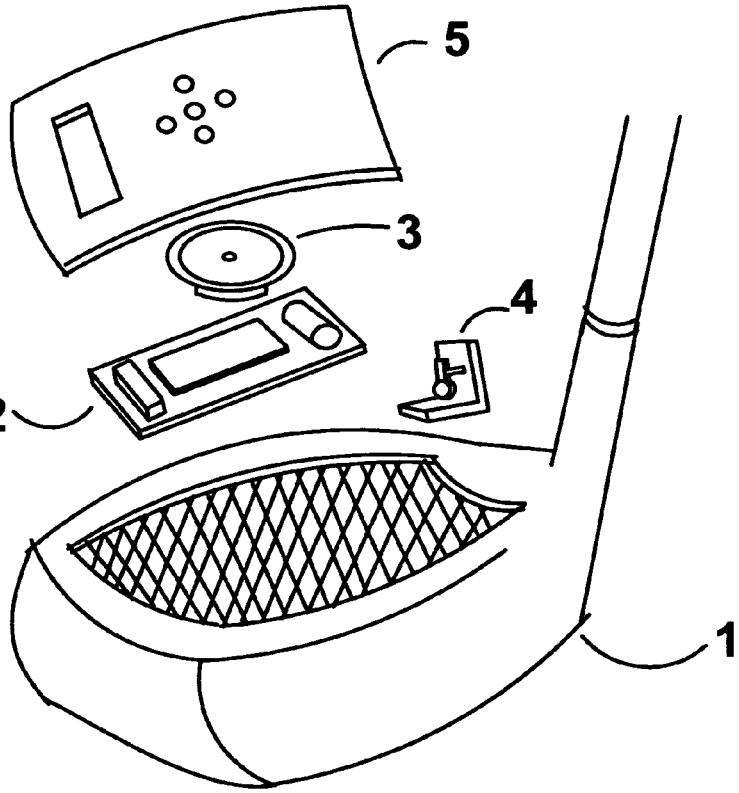
FIG. 1 is an exploded view of all the components included with a golf club that comprise of the device.

FIG. 1 is a view of the components that comprise the device. Trigger switch assembly 4 senses the initial movement of a golf swing and provides an electrical signal to circuit board 2. Circuit board 2 comprises of a battery source, address selection switches, and a semiconductor device ISD2575 CHIPCORDER manufactured by WINDOND ELECTRONICS CORPORATION. Speaker 3 is attached to Cover 5 and provides the means to play the sound files stored on circuit board 2. Golf club head 1 provides a housing for the components and also creates an acoustical chamber for the benefit of sound quality.

Figure 2:
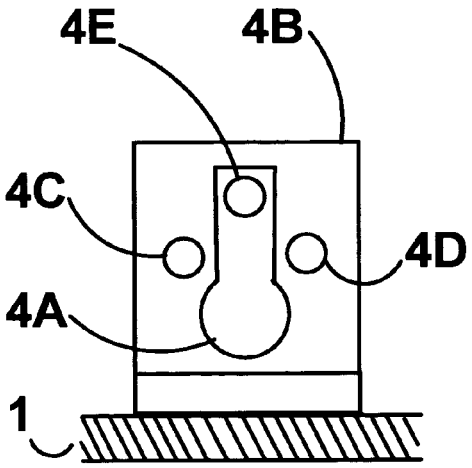
FIGS. 2 and 2B are views of the trigger switch.
Figure 2B:
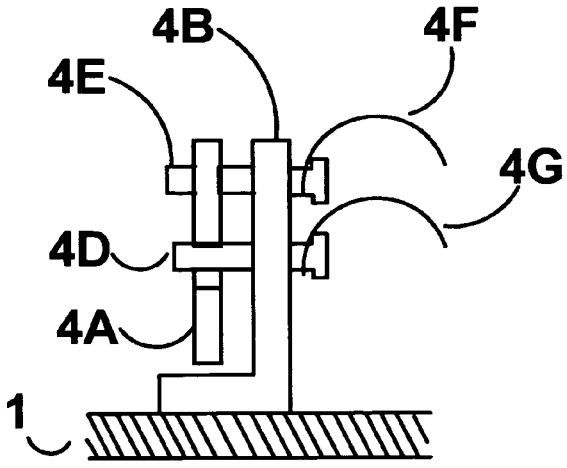

Referring now to FIGS. 2 and 2*b*, further details of the trigger switch assembly will be described. Mount 4*b* is constructed of non-conductive material and provides the means for attachment to golf club head 1 of FIG. 1. Pendulum 4*a* is constructed of conductive material and hangs freely from screw 4*e*. Screw 4*e* is constructed of conductive material and is attached to conductor 4*f*. Contact 4*d* is constructed of conductive material and is attached to conductor 4*g*. Stop 4*c* provides a means to limit the range of motion for pendulum 4*a*. FIG. 2 depicts the position of pendulum 4*a* when the device and included golf club are held in common golf address position, the club shaft being held vertically with the club head on the ground adjacent to a golf ball. When a golfer initiates a golf swing the club is accelerated away from the ball. At said instant pendulum 4*a* strikes contact 4*d* and presents a closed circuit to conductors 4*f* and 4*g*. Conductors 4*f* and 4*g* transmit the status of said circuit to circuit board 2 of FIG. 1.

Figure 3:
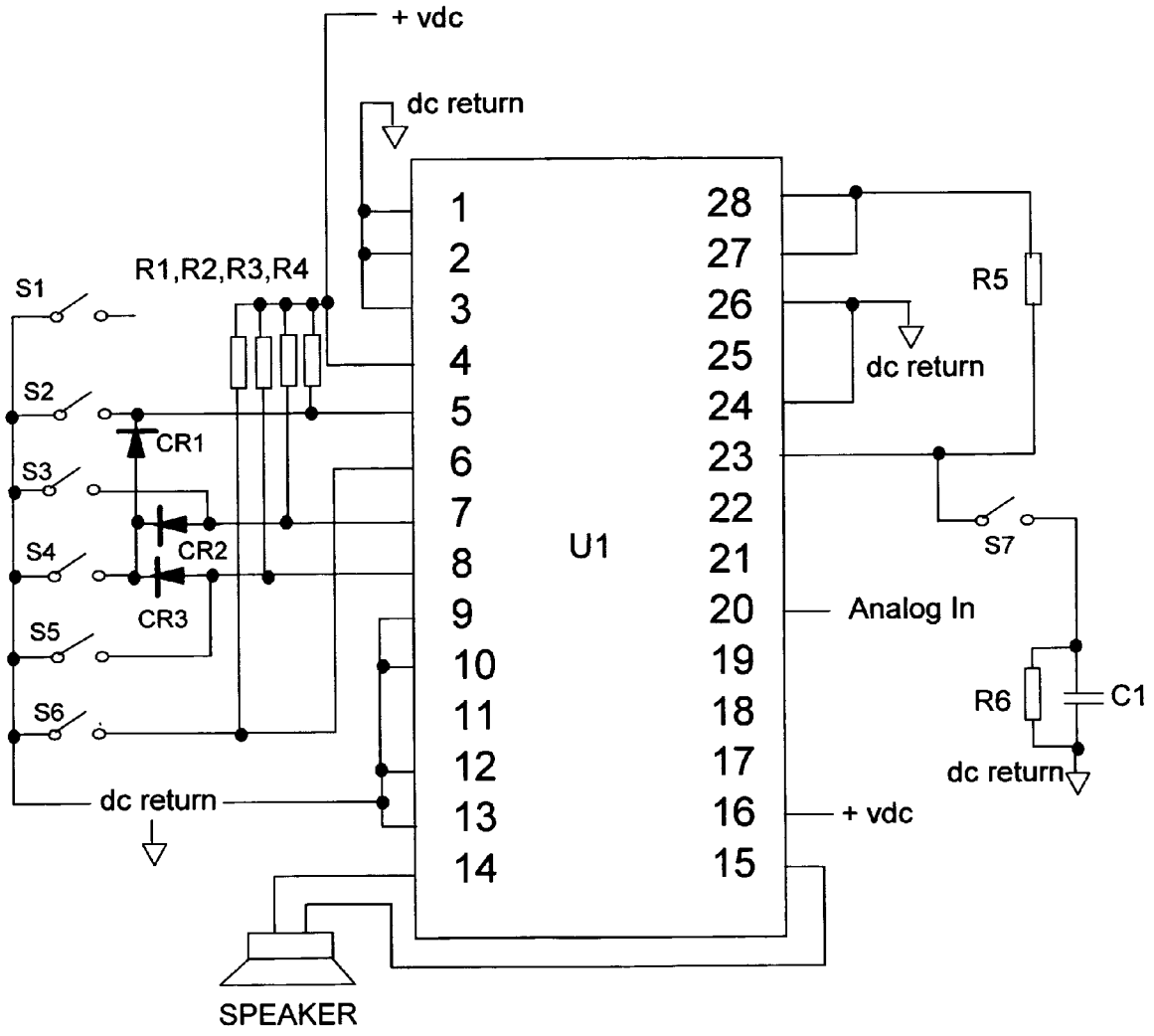
FIG. 3 is a circuit diagram of a preferred embodiment of the present invention.

Referring now to FIG. 3, a circuit diagram of the device will be described. Semiconductor device U1 is an addressable record and playback device with ability to store recorded sounds. Switch S7 of FIG. 3 is the circuit created by trigger switch assembly 4 of FIG. 1. Positive voltage from pin 28 of U1 is provided to pin 23 of U1 through resistor R5. When trigger switch S7 closes, pin 23 of U1 is pulled towards battery supply return through capacitor C1, creating a low voltage pulse. When trigger switch S7 is open resistor R6 provides a discharge path for capacitor C1, resetting the circuit. Semiconductor U1 responds to a low pulse on pin 23 by playing a recorded sound file stored at a specific address set by the combination of components: Diodes CR1, CR2, CR3, Resistors R1, R2, R3, R4, and Switches S1, S2, S3, S4, S5, S6. Pin 20 of U1 provides the means to input recorded sound files.

Figure 4:
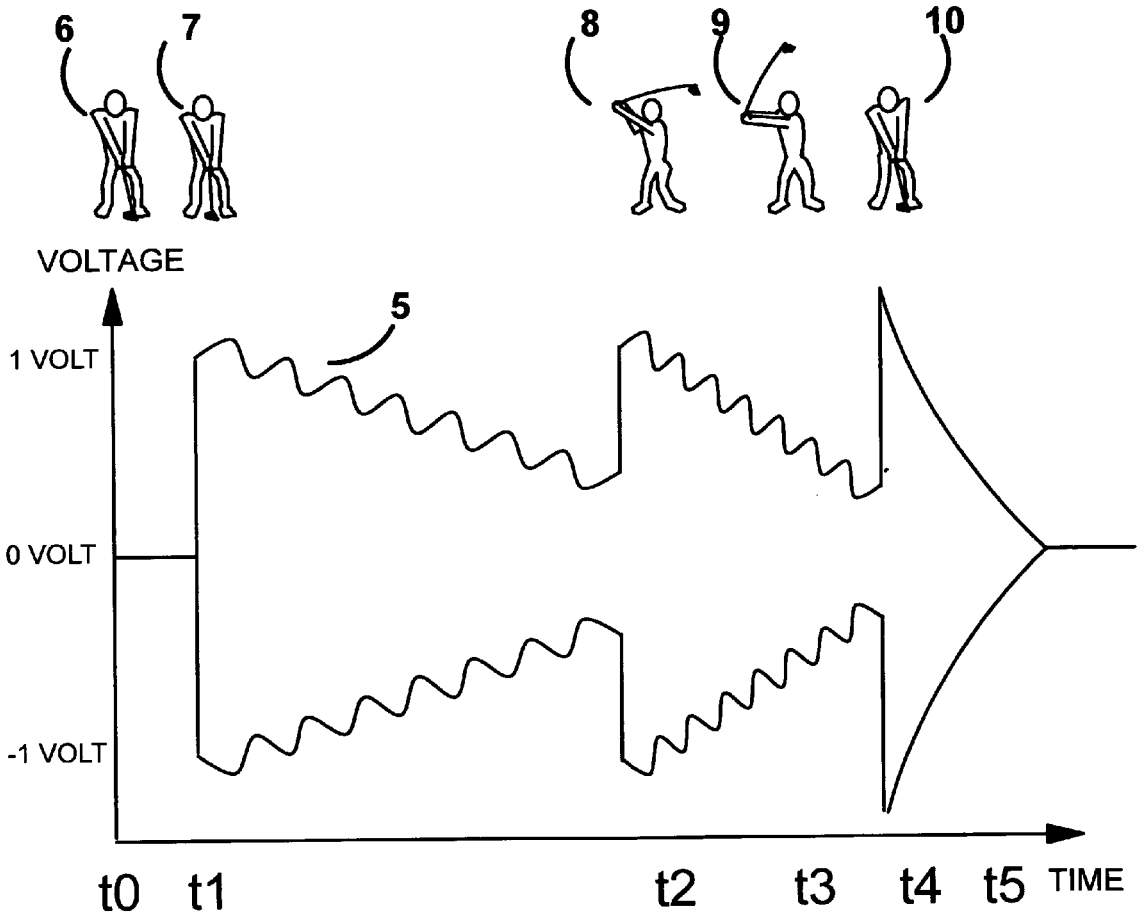
FIG. 4 is a waveform diagram of a recorded sound file and the corresponding positions of a golfer performing a synchronized golf swing.

Referring now to FIG. 4, a waveform diagram of a recorded sound file utilized in the preferred embodiment of the invention will be described. At time T0 the golfer is in common address position and trigger switch 4 of FIG. 1 is an open circuit. At time T1, the golfer has initiated the golf swing and trigger switch 4 of FIG. 1 has closed. Additionally, at time T1 the closure of trigger switch 4 of FIG. 1 is sensed by circuit board 2 of FIG. 1. Additionally, the playing of the specifically selected sound file (5 of FIG. 4) begins. In this preferred embodiment of the present invention the sound played during the period of time between times T1 and T2 is the musical note Treble Cleft A. Additionally, in this preferred embodiment of the present invention the sound played during the period of time between times T2 and T3 is the musical note Treble Cleft C. Additionally in this preferred embodiment of the present invention the sound played during the period of time between times T3 and T4 is the musical note Treble Cleft A Flat. Additionally in this preferred embodiment of the present invention the sound played during the period of time between time T4 and T5 is the recorded sound of a golf club striking of a golf ball.

Referring further to FIG. 4 the positions of golfers G0, G1, G2, G3, G4 will be described. Golfer G0 (6 of FIG. 4) is common golf address position, the club shaft being held vertically with the club head on the ground adjacent to a golf ball. Golfer G1 (7 of FIG. 4) is the initial movement of the golf swing and the start of the playing of the sound file is synchronized to this movement by the present invention. Golfer G2 (8 of FIG. 4) is completing the back swing portion of the golf swing. Golfer G3 (9 of FIG. 4) has completed his swing but for the striking of the ball. Golfer G4 (10 of FIG. 4) is striking the ball.

What is claimed is:

1. A Golf Training Club comprising of:

a) a golf club;

b) a speaker included within said golf club;

c) a circuit board included within said golf club;

d) switches within the golf club connected to said circuit board providing a means to select a specific memory address of stored sound on said circuit board; and e) a trigger switch included within said golf club providing the means to detect initial movement of the golf club during a golf swing.

2. A Golf Training Club according to claim 1 wherein said circuit board provides the means to play, in response to said trigger switch, a sound of musical notes plus a distinctive swish-click sound produced when a swinging golf club accelerates and strikes a golf ball, in succession.

3. A Golf Training Club according to claim 2 wherein the sound produced by said circuit board in response to said trigger switch is audibly continuous, without pause for the entirety of the play.

4. A Golf Training Club according to claim 2, wherein the sound played by said circuit board, in response to said trigger switch, represents the rhythm and timing of a golf swing.

5. A golf training club according to claim 1, wherein said trigger switch comprises a pendulum and a contact; wherein the pole of the switch is the pendulum and the contact is stationary.

6. A method of using a training club according to claim 1, wherein the training club senses the golfers first movement and automatically guides the golfers rhythm with electronically produced sound.

* * * * *